United States Patent [19]

Johnson

[11] 4,082,161

[45] Apr. 4, 1978

[54] CONTINUOUS ADJUSTING SCAFFOLD

[76] Inventor: Curtis L. Johnson, Rte. 3, Box 42, Adamsville, Ala. 35005

[21] Appl. No.: 669,965

[22] Filed: Mar. 24, 1976

[51] Int. Cl.[2] ..... E04G 3/10

[52] U.S. Cl. ..... 182/82; 182/142; 182/187; 182/223

[58] Field of Search ..... 182/142, 128, 187, 179, 182/178, 223, 82

[56] References Cited

U.S. PATENT DOCUMENTS

| | | | |
|---|---|---|---|
| 2,623,643 | 12/1952 | Seamans | 182/187 |
| 3,265,156 | 8/1966 | Jacobs | 182/223 |
| 3,908,793 | 9/1975 | Vaughn | 182/223 |

FOREIGN PATENT DOCUMENTS

| | | | |
|---|---|---|---|
| 2,119,720 | 4/1971 | Germany | 182/187 |

*Primary Examiner*—Reinaldo P. Machado
*Attorney, Agent, or Firm*—George R. Douglas, Jr.; Anthony D. Cennamo

[57] ABSTRACT

A scaffolding assembly for use particularly in the construction of large holding tanks and which incorporates a novel construction and method of being raised from one level to another, the device including a series of scaffold sections made of aluminum and steel, the sections being pivotally attached together to conform to the tank contour, each section having brackets secured therebeneath that fit into bracket straps welded to the tank wall; the entire assembly being raised together on sky climbers in which all hoists are controlled by a single switch so to lift the assembly all together from an old set of straps to a new set thereabove.

3 Claims, 15 Drawing Figures

20
21
22
23
24

35
37
40

36

39

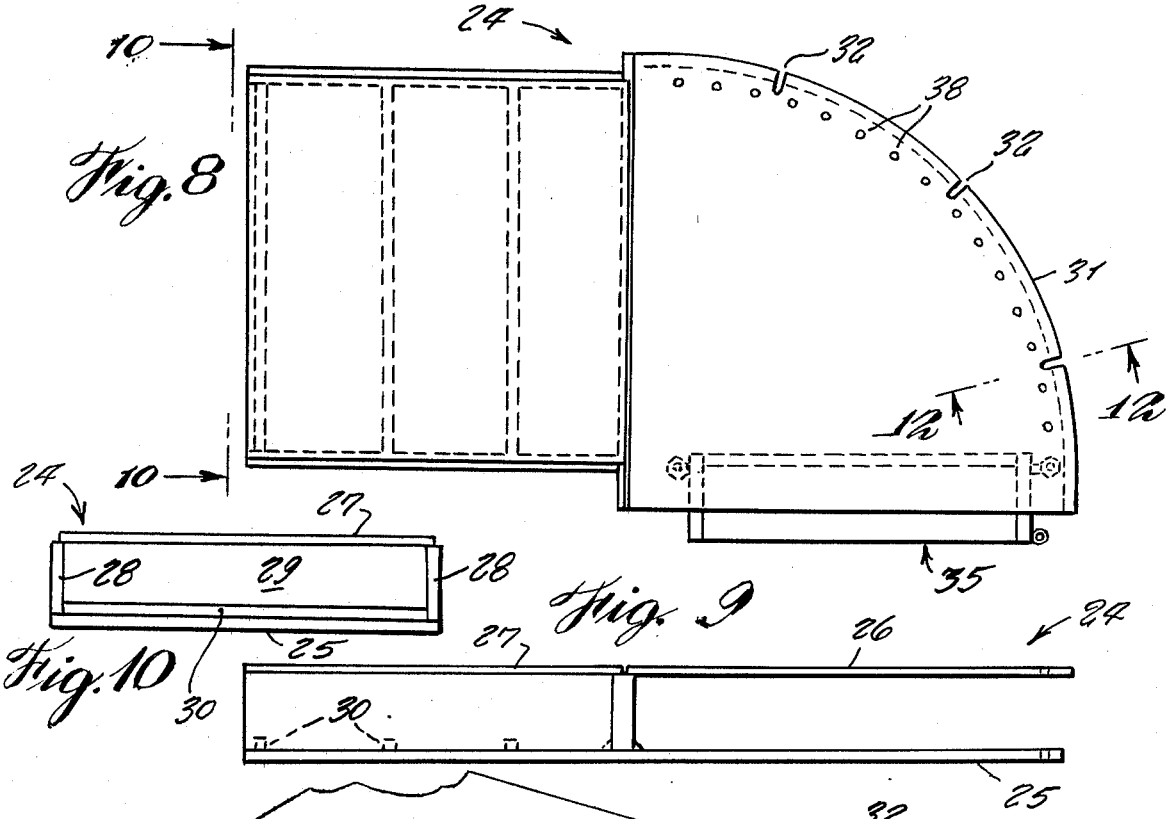
Fig. 8
Fig. 10
Fig. 9
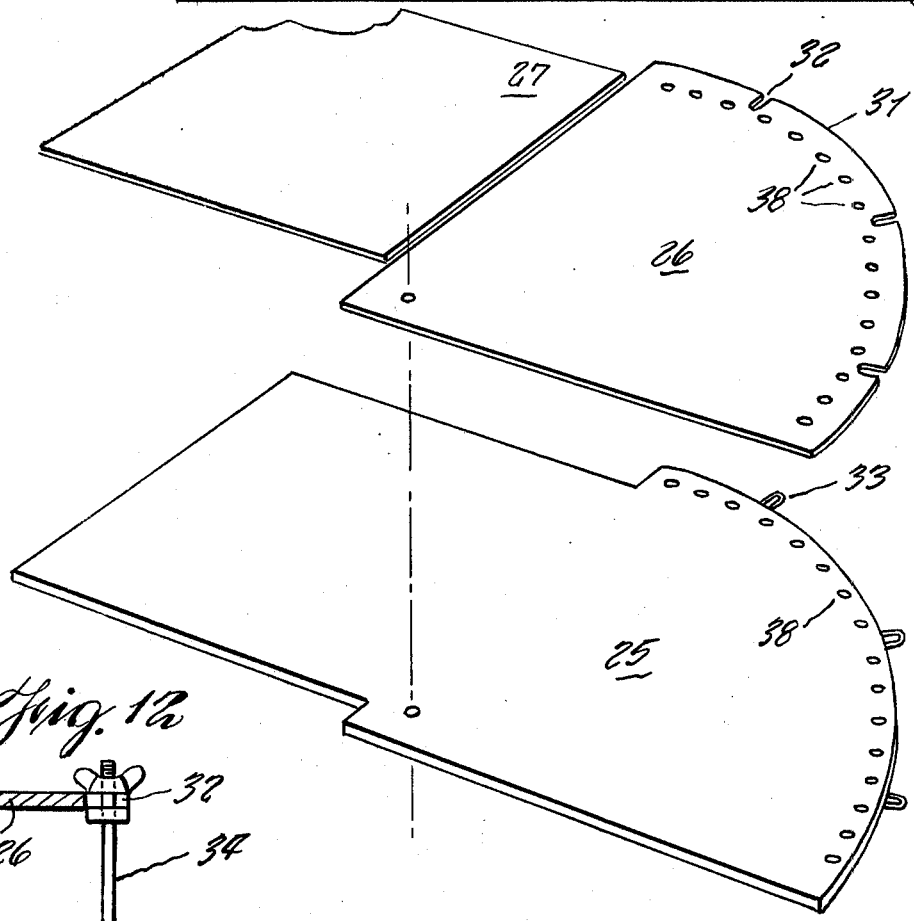
Fig. 11
Fig. 12
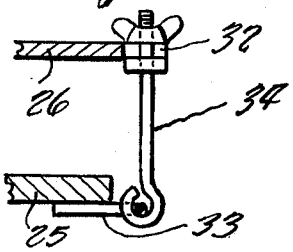

CONTINUOUS ADJUSTING SCAFFOLD

This invention relates generally to scaffolding, especially to such as is used in the construction of large tanks and vessels.

Scaffolding presently used in tank construction is far from being ideal; when being raised, the work is physically very hard and dangerous; conventional scaffolds using three wood boards in each bay which must be passed one at a time from a man standing on a scaffold that he is dismantling to a man above where a new scaffold is being assembled; both men working much of the time without any safety post and handrail ropes while this equipment is dismantled, so that they are unprotected from falling.

Conventional scaffolds presently being used, consist of three 2 × 12 inch wooden boards. Each time that it is necessary to move from one elevation to another, all handrails and safety equipment must be removed. Raising or lowering of scaffolding is a dangerous and time-consuming operation. Scaffolds that are used on tanks have the 2 by 12 inch boards usually ranging from 8 to 14 feet long. The three boards form a bay defined between the two brackets that are put on the tank wall. It is hard for a man to stand on more than one board at a time and it is hard to find boards that are not knot-free and that have been safety tested. It is also difficult to keep the boards from spreading apart and leaving a gap between the boards that could be stepped through. This situation is objectionable and is therefore in want of an improvement.

Accordingly, it is a principal object of the present invention to provide a continuous adjusting scaffold that overcomes the above offensive features, which is lighter in weight, less cumbersome than existing scaffolds, can be completely assembled upon a ground and is not necessary to disassemble until a job is finished. Once the scaffold is stationary, the rigging for lifting can be removed and used on another scaffold.

Another object is to provide a continuous adjusting scaffold which can be used on any size tank or building from 25 to 300 or more feet in diameter, and which will adjust to fit circular tanks or make 90° angles.

Still another object is to provide a continuous adjusting scaffold wherein it is not necessary to remove safety equipment in order to adjust the scaffold.

Other objects are to provide a continuous adjusting scaffold which is simple in design, inexpensive to manufacture, rugged in construction, easy to use, and efficient in operation.

These and other objects will be readily evident upon a study of the following specification and the accompanying drawing, wherein:

FIG. 8 is a plan view of an adjustable scaffold connector.

FIG. 9 is a front edge view thereof shown with swing arm omitted.

FIG. 10 is a view in direction 10—10 of FIG. 8.

FIG. 11 is an exploded perspective view of the plates.

FIG. 12 is an enlarged cross section on line 12—12, FIG. 8 showing the latching means between the plates.

Figure 1:
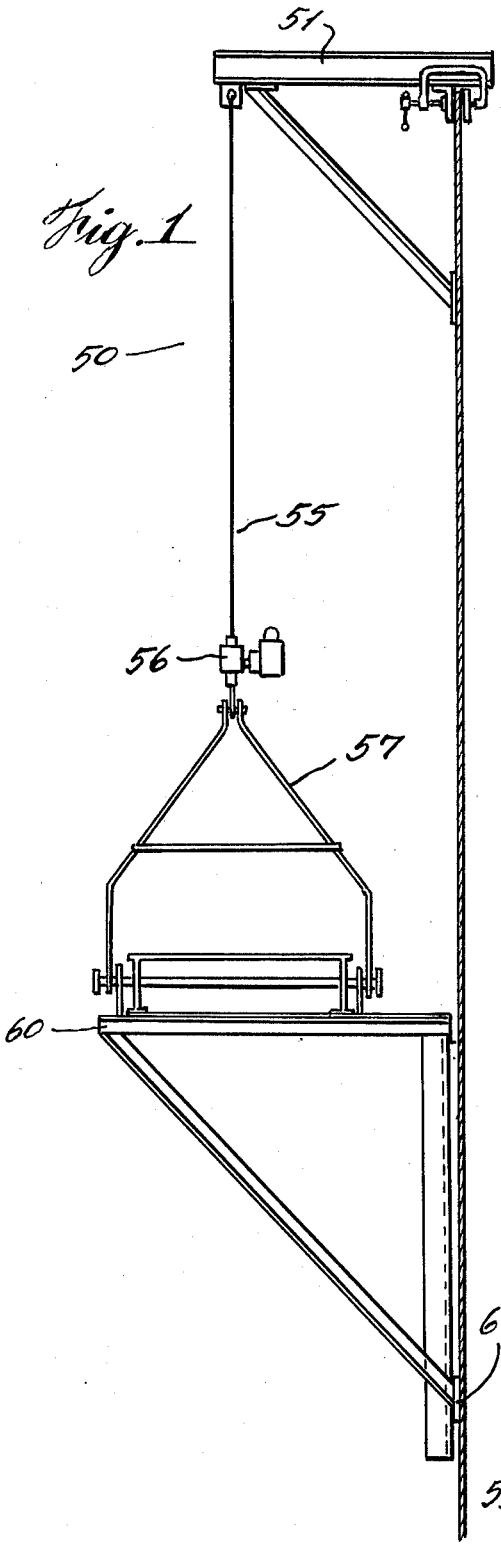
FIG. 1 is an end view of the scaffold and a rigging for positioning the scaffold.
Figure 2:
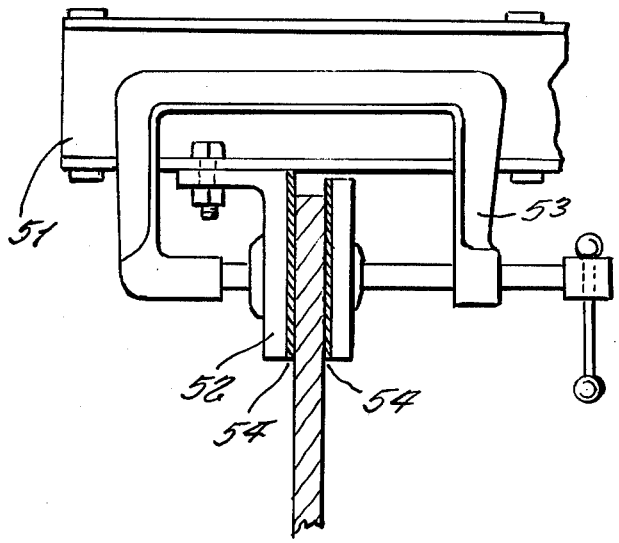
FIG. 2 is an enlarged detail of the rigging clamp unit for securement to an upper edge of a tank.
Figure 3:
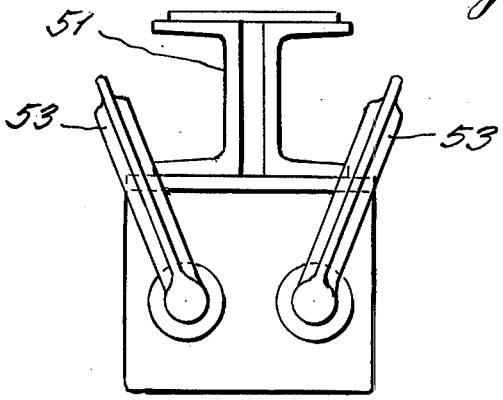
FIG. 3 is an end view thereof.
Figure 4:
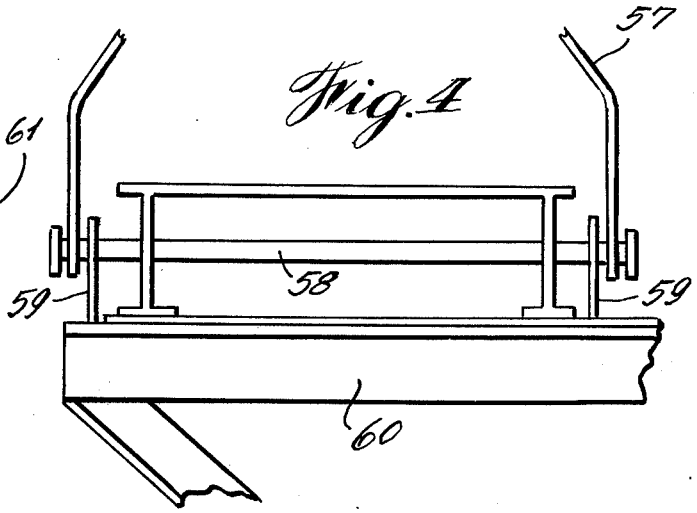
FIG. 4 is an end view of a scaffold and rigging interconnecting lifting pin structure.

Referring now to the drawings in detail, the reference numeral 20 represents a continuous adjusting scaffold assembly according to the present invention wherein the same is comprised of scaffold sections 21, one of which is for each bay around either an outer side or inner side of a tank 22. Each scaffold section includes a scaffold 23 and a connector 24 for enjoining adjacent sections together.

The connector includes a bottom plate 25, upper corner plate 26, a top plate 27 connected by vertical side plates 28 to the bottom plate. A channel opening 29 is thus formed at one end to receive one end of the scaffold 23. Cleats 30 are welded upon the bottom plate.

The corner plate has a rounded edge 31 having notches 32, and the bottom plate has a corresponding rounded edge with U-shaped staples 33 welded thereto. Latch bolts 34 between the staples and notches connect the bottom and upper plate, as shown in FIG. 12.

A swing arm 35 pivotable about bolt 36 is movable in a channel formed between the upper and bottom plates. A pipe 37 of the swing arm aligns selectively with openings 38 on the upper and bottom plates for bolt securement. The swing arm connects to a scaffold of an adjacent bay.

Figures 5, 6, 7, 13, 14, 15:
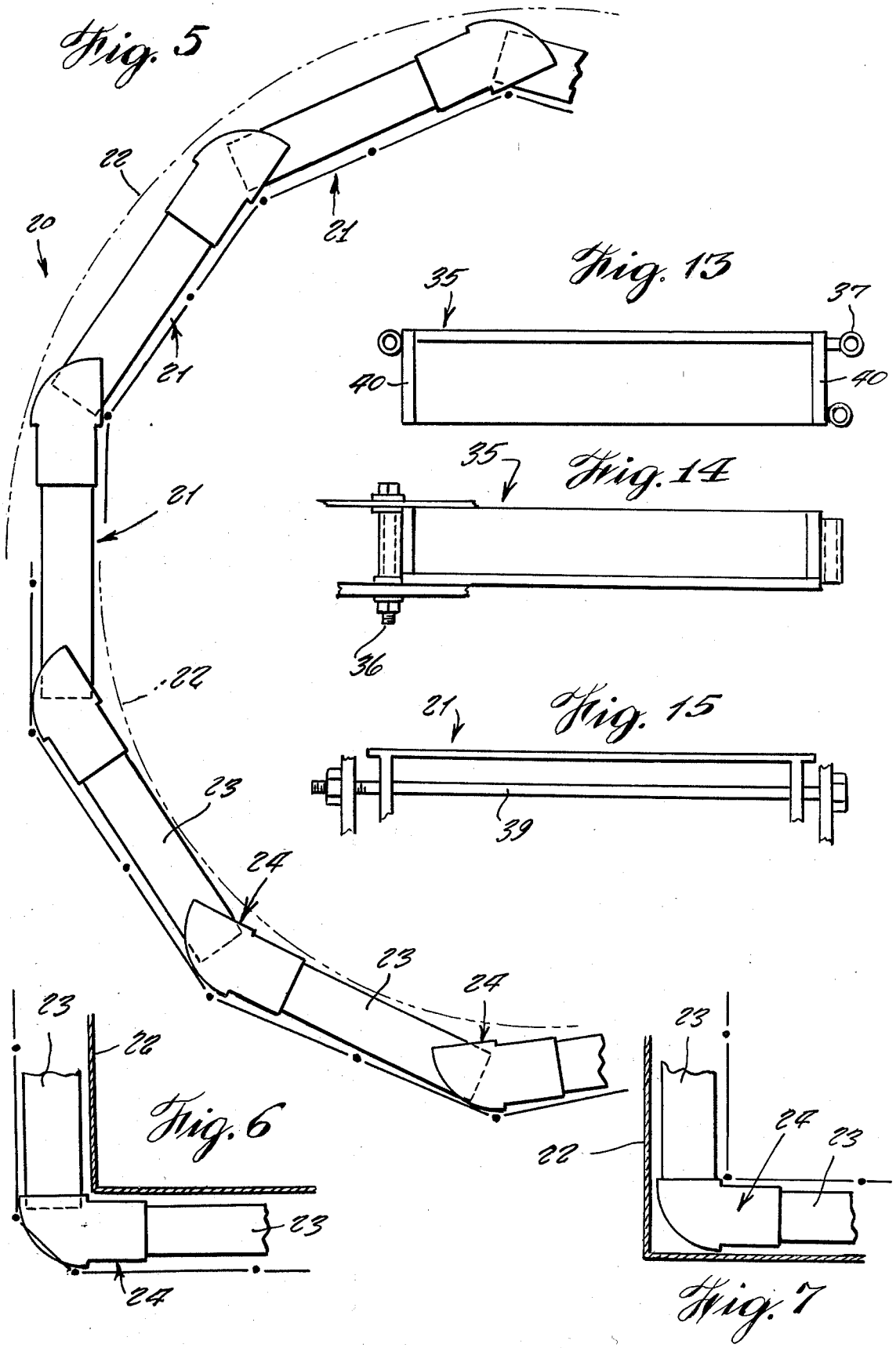
FIG. 5 is a plan view of an assembly of scaffolds positioned against an outer and against an inner side of a circular tank.
FIG. 6 is a plan view showing scaffolds positioned around an outer side of a square corner.
FIG. 7 shows scaffolds positioned in an inside of a square corner.
FIG. 13 is a top view of the swing arm.
FIG. 14 is a front edge view thereof.
FIG. 15 is a side view of a rod shown securing the scaffold to a connector.

As shown in FIG. 15, rods 39 secure the opposite ends of the scaffold to the plates 28 or to plates 40 of the swing arm.

The scaffold board is aluminum pick board 6 inches wide. It is one piece.

As a tank is built, one ring of plates welded on top of a ring of plates therebeneath, the scaffold assembly 20 is progressively raised for the workmen. Sky climbers 50 are hooked from the top ring, thirty feet apart. The sky climber includes cantilever 51 bolted to angle 52 which is clamped by two clamps 53 adjacent the upper end of the top ring. Gasketing material 54 is adhered to the faces of the clamp and the angle for grasping the tank wall therebetween. A cable 55 from each cantilever extends down to a hoist 56 hooked to a stirrup 57 to which the scaffold is attached by a lifting pin 58 that also is passed through upward plates 59 of a bracket 60 upon which the scaffold rests, the bracket being supported in bracket straps welded to a side of the tank.

To raise the tank, bracket straps 61 are welded on the top ring. A single control switch connected to all the hoists then raises the entire continuous adjusting scaffold together with the brackets 60 from their supporting straps. The scaffold is raised sufficiently so that the brackets are about one or two inches above the new straps. The workmen then walk around the scaffold to check the alignment of the brackets with the straps 61, after which the scaffold assembly is lowered slightly so to lock the brackets in the new straps. The entire sky climber can then be removed for use elsewhere if wished, particularly on other tanks if several tanks are being erected at a same time at the same installation.

The scaffold raising can be done by only two men on a 100 foot diameter tank in less than an hour.

Thus an improved scaffolding is provided.

I claim:

1. A continuous adjusting scaffold comprising in combination a plurality of scaffold sections pivotally attached together, each section including a scaffold of aluminum pick board in one piece and a steel plate connector, wherein, said connector including a channel between upper and bottom steel plates, said channel at each end having means receiving a scaffold adjacently positioned thereto, wherein, a swing arm being pivotally connected to said connector and being located within one end of said channel, said swing arm being connectable to said scaffold at said one end.

2. The combination as set forth in claim 1, wherein supporting brackets are secured to an underside of said scaffold section, said brackets being slidable downwardly into bracket straps welded on a side of a tank.

3. The combination as set forth in claim 2, wherein a plurality of sky-climbers are clamped around an upper end of a tank wall, said sky climbers each including a cantilever with a pair of clamps, a cable to a hoist adjacent a stirrup for handling the scaffold, and all said hoists being electrically connected to a single control switch.

* * * * *